US012773593B2

(12) United States Patent
Jung et al.

(10) Patent No.: US 12,773,593 B2
(45) Date of Patent: Oct. 27, 2026

(54) METHOD OF DETERMINING ARM POSTURE OF USER AND ELECTRONIC DEVICE FOR PERFORMING THE METHOD

(71) Applicant: Samsung Electronics Co., Ltd., Suwon-si (KR)

(72) Inventors: Joonyoung Jung, Suwon-si (KR); Chiyul Yoon, Suwon-si (KR); Sanghun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 97 days.

(21) Appl. No.: 18/813,673

(22) Filed: Aug. 23, 2024

(65) Prior Publication Data

US 2024/0416176 A1 Dec. 19, 2024

Related U.S. Application Data

(63) Continuation of application No. PCT/KR2024/006264, filed on May 9, 2024.

(30) Foreign Application Priority Data

Jun. 13, 2023 (KR) ..... 10-2023-0075740

(51) Int. Cl.
*A63B 24/00* (2006.01)

(52) U.S. Cl.
CPC ..... *A63B 24/0021* (2013.01); *A63B 2220/13* (2013.01); *A63B 2220/16* (2013.01);
(Continued)

(58) Field of Classification Search
CPC ..... A63B 24/0021; A63B 2220/13; A63B 2220/16; A63B 2220/20; A63B 2220/833;
(Continued)

(56) References Cited

U.S. PATENT DOCUMENTS 4,993,705 A * 2/1991 Tolle ..... A63B 21/4043 482/139
5,518,480 A * 5/1996 Frappier ..... A63B 21/4007 482/129

(Continued)

FOREIGN PATENT DOCUMENTS

CN 105287166 A 2/2016
CN 109453505 A 3/2019

(Continued)

OTHER PUBLICATIONS

Wenchuan Wei, et al., "Real-Time 3D Arm Motion Tracking Using the 6-axis IMU Sensor of a Smartwatch", IEEE, downloaded Dec. 7, 2022, 4 pages.

(Continued)

*Primary Examiner* — Andrew S Lo
(74) *Attorney, Agent, or Firm* — Nixon & Vanderhye P.C.

(57) ABSTRACT

A method of determining an arm posture of a user may include determining a distance from a first part of a body of the user to a second part of a lower arm of the user based on length information of a cable generated by a first sensor arranged on at least a part of the body of the user, determining a first rotation angle of the lower arm in a three-dimensional space based on rotation information generated by a second sensor attached to the second part, determining a second rotation angle of an upper arm in the three-dimensional space based on the distance from the first part to the second part and the first rotation angle of the lower arm, determining a position of the upper arm and a position of the lower arm in the three-dimensional space based on the first rotation angle of the lower arm and the second rotation angle of the upper arm; and determining the arm posture based on the position of the upper arm and the position of the lower arm.

20 Claims, 13 Drawing Sheets

(52) U.S. Cl.
CPC ..... *A63B 2220/20* (2013.01); *A63B 2220/833* (2013.01); *A63B 2220/836* (2013.01); *A63B 2225/02* (2013.01); *A63B 2230/62* (2013.01)

(58) Field of Classification Search
CPC ..... A63B 2220/836; A63B 2225/02; A63B 2230/62; A63B 21/4033; A63B 2071/0647; A63B 2071/0663; A63B 2071/0666; A63B 2220/72; A63B 2225/20; A63B 2225/50; A63B 21/4007; A63B 21/4021; A63B 21/4025; A63B 21/4043; A63B 23/03533; A63B 23/1209; A63B 24/0087; A63B 71/0622; A63B 21/153; A63B 21/0058; A63B 21/0442; A63B 21/0552; A63B 2220/40; A63B 2220/51; A63B 2230/06; A61B 5/6824; A61B 5/11
See application file for complete search history.

(56) References Cited

U.S. PATENT DOCUMENTS 5,683,336 A * 11/1997 Pape ..... A63B 23/03541 482/121
5,792,034 A * 8/1998 Kozlovsky ..... A63B 21/4009 482/124
5,993,362 A * 11/1999 Ghobadi ..... A63B 21/4015 482/121
6,099,446 A * 8/2000 Johnson ..... A63B 21/4005 482/124
7,608,026 B1 * 10/2009 Nicassio ..... A63B 21/4015 482/121
7,850,583 B2 * 12/2010 Smith ..... A63B 21/4001 482/124
10,049,595 B1 * 8/2018 Chuang ..... G16Z 99/00
10,768,691 B2 9/2020 Ranieri et al.
11,531,392 B2 * 12/2022 Erivantcev ..... G06F 3/0346
12,151,134 B2 * 11/2024 Park ..... A63B 21/00043
2018/0021624 A1 * 1/2018 Cordero ..... A63B 21/154 601/48
2018/0150131 A1 * 5/2018 Ranieri ..... G06F 3/017
2020/0030177 A1 * 1/2020 Zentgraf ..... A61H 1/0274
2022/0265168 A1 * 8/2022 Wei ..... A61B 5/7267
2024/0099934 A1 * 3/2024 Stanfield ..... A41D 13/12

FOREIGN PATENT DOCUMENTS

CN 115227235 A 10/2022
JP 2018-069432 A 5/2018
JP 2020-501733 A 1/2020
KR 10-2016-0052882 A 5/2016
KR 10-2019-0103263 A 9/2019
KR 102167254 B1 10/2020
KR 10-2022-0031862 A 3/2022
WO 2022182096 A1 9/2022

OTHER PUBLICATIONS

Wenchuan Wei, et al., "Real-Time Limb Motion Tracking with a Single IMU Sensor for Physical Therapy Exercises", 2021 43rd Annual International Conference of the IEEE Engineering in Medicine & Biology Society (EMBC), Oct. 31-Nov. 4, 2021, pp. 7152-7157 (6 pages).
PCT International Search Report dated Aug. 19, 2024 for PCT/KR2024/006264.

* cited by examiner

METHOD OF DETERMINING ARM POSTURE OF USER AND ELECTRONIC DEVICE FOR PERFORMING THE METHOD

CROSS-REFERENCE TO RELATED APPLICATIONS

This application is a continuation application of International Application No. PCT/KR2024/006264 designating the United States, filed on May 9, 2024, in the Korean Intellectual Property Receiving Office and claiming priority to Korean Patent Application No. 10-2023-0075740, filed on Jun. 13, 2023, in the Korean Intellectual Property Office, the disclosures of which are all hereby incorporated by reference herein in their entireties.

BACKGROUND

1. Field

Certain example embodiments relate to a technique for determining an arm posture of a user of a wearable exercise apparatus.

2. Description of Related Art

A change into aging societies has contributed to a growing number of people who experience inconvenience and pain from reduced muscular strength or joint problems due to aging. Thus, there is a growing interest in assist devices that assist elderly users or other patients with reduced muscular strength or joint problems to exercise more conveniently.

SUMMARY

According to an example embodiment, an electronic device may include at least one processor comprising processing circuitry, and memory storing instructions that when executed by the at least one processor individually and/or collectively, cause the electronic device to at least: determine a distance from a first part of a body of a user to a second part of a lower arm of the user based on length information of a cable generated by a first sensor arranged on at least a part of the body of the user, determine a first rotation angle of the lower arm in a three-dimensional space based on rotation information generated by a second sensor attached to the second part, determine a second rotation angle of an upper arm in the three-dimensional space based on the distance from the first part to the second part and the first rotation angle of the lower arm, determine a position of the upper arm and a position of the lower arm in the three-dimensional space based on the first rotation angle of the lower arm and the second rotation angle of the upper arm, and determine an arm posture of the user based on the position of the upper arm and the position of the lower arm.

According to an example embodiment, a method of determining an arm posture of a user may include determining a distance from a first part of a body of the user to a second part of a lower arm of the user based on length information of a cable generated by a first sensor arranged on at least a part of the body of the user, determining a first rotation angle of the lower arm in a three-dimensional space based on rotation information generated by a second sensor attached to the second part, determining a second rotation angle of an upper arm in the three-dimensional space based on the distance from the first part to the second part and the first rotation angle of the lower arm, determining a position of the upper arm and a position of the lower arm in the three-dimensional space based on the first rotation angle of the lower arm and the second rotation angle of the upper arm, and determining the arm posture based on the position of the upper arm and the position of the lower arm.

According to an example embodiment, a wearable device may include a first sensor connected, directly or indirectly, to a cable, at least one processor comprising processing circuitry, and memory storing instructions that when executed by the at least one processor individually and/or collectively, cause the electronic device to: at least determine a distance from a first part of a body of a user to a second part of a lower arm of the user based on length information of the cable generated by the first sensor arranged on at least a part of the body of the user, determine a first rotation angle of the lower arm in a three-dimensional space based on rotation information generated by a second sensor attached to the second part, determine a second rotation angle of an upper arm in the three-dimensional space based on the distance from the first part to the second part and the first rotation angle of the lower arm, determine a position of the upper arm and a position of the lower arm in the three-dimensional space based on the first rotation angle of the lower arm and the second rotation angle of the upper arm, and determine an arm posture of the user based on the position of the upper arm and the position of the lower arm.

BRIEF DESCRIPTION OF THE DRAWINGS

The above and other aspects, features, and advantages of certain example embodiments will be more apparent from the following detailed description, taken in conjunction with the accompanying drawings, in which.

DETAILED DESCRIPTION

Figure 1A:
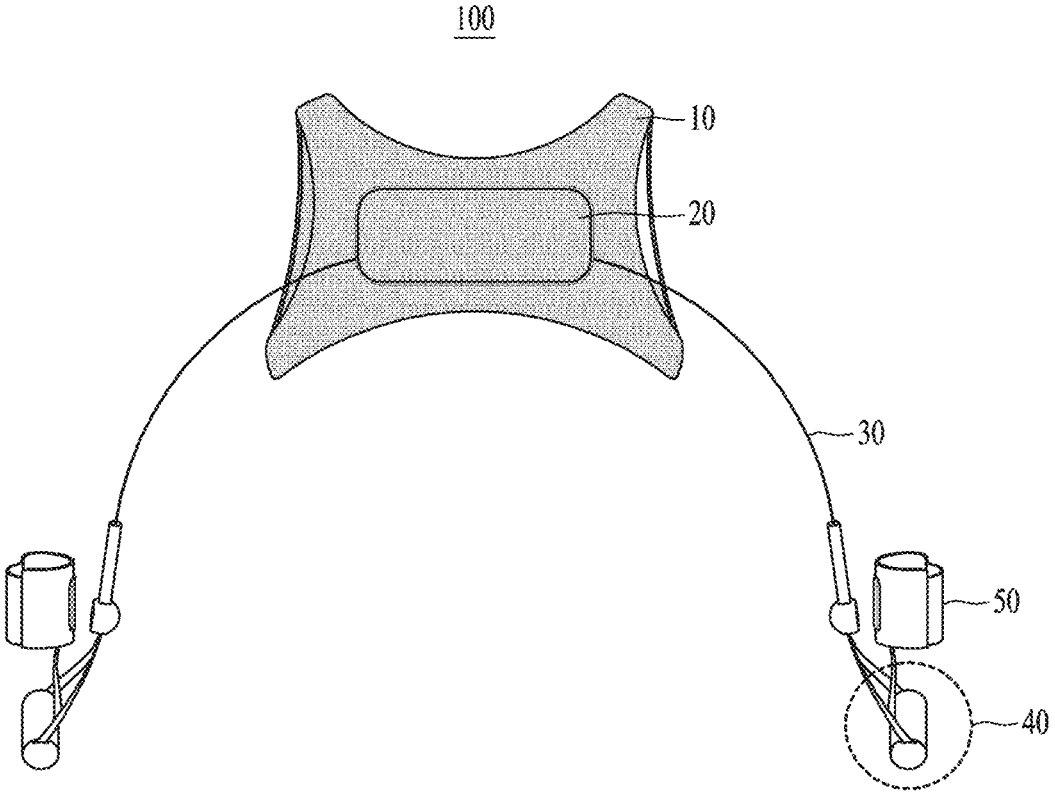
FIG. 1A illustrates a wearable device to be worn on a body of a user according to an example embodiment.

Hereinafter, various example embodiments will be described with reference to the accompanying drawings. However, this is not intended to limit the present disclosure to specific embodiments, and it should be understood that various modifications, equivalents, and/or alternatives of the embodiments are included.

However, various alterations and modifications may be made to the embodiments. Thus, the embodiments are not meant to be limited by the descriptions of the present disclosure. The embodiments should be understood to include all changes, equivalents, and replacements within the idea and the technical scope of the disclosure.

The singular forms "a," "an," and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which the embodiments belong. Terms defined in dictionaries generally used should be construed as having meanings matching contextual meanings in the related art and are not to be construed as having an ideal or excessively formal meaning unless otherwise defined herein.

When describing the embodiments with reference to the accompanying drawings, like reference numerals refer to like constituent elements and a repeated description related thereto will be omitted. In the description of embodiments, detailed description of well-known related structures or functions will be omitted when it is deemed that such description will cause ambiguous interpretation of the present disclosure.

Also, in the description of the components, terms such as first, second, A, B, (a), (b) or the like may be used herein when describing components of the present disclosure. These terms are used only for the purpose of discriminating one constituent element from another constituent element, and the nature, the sequences, or the orders of the constituent elements are not limited by the terms. When one constituent element is described as being "connected", "coupled", or "attached" to another constituent element, it should be understood that one constituent element can be connected or attached directly to another constituent element, and/or at least one intervening constituent element(s) can also be "connected", "coupled", or "attached" to the constituent elements, so that these terms cover both direct and indirect connections/couplings/attachments.

The same name may be used to describe an element included in the embodiments described above and an element having a common function. Unless otherwise mentioned, the descriptions of the examples may be applicable to the following examples and thus, duplicated descriptions will be omitted for conciseness.

Figure 1B:
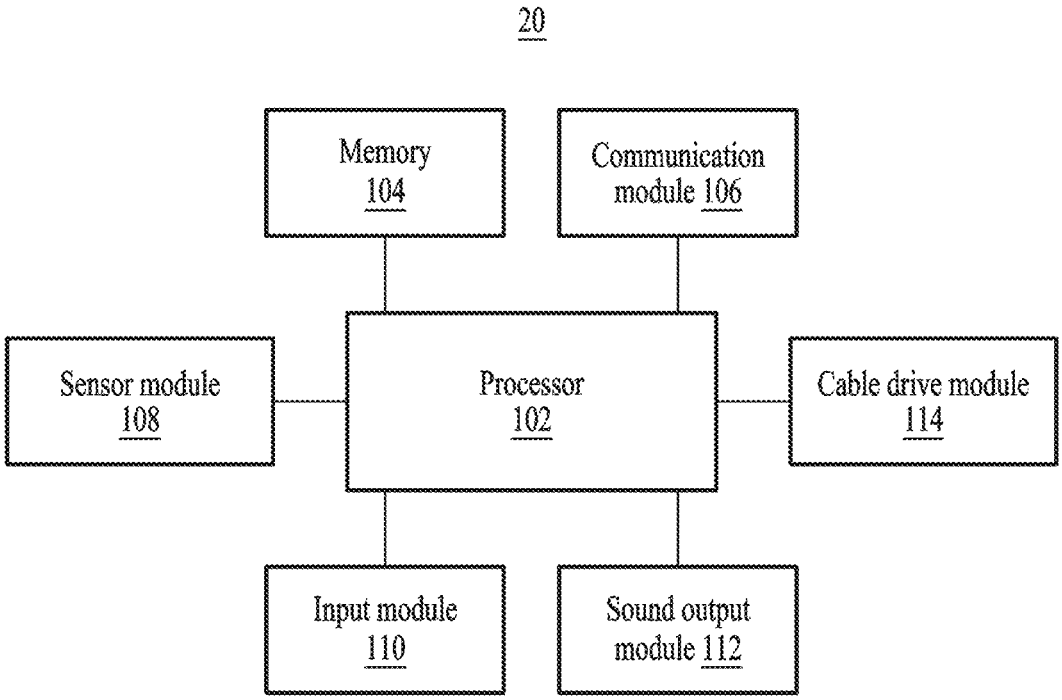
FIG. 1B illustrates a configuration of a control system of a wearable device according to an example embodiment.
Figure 1C:
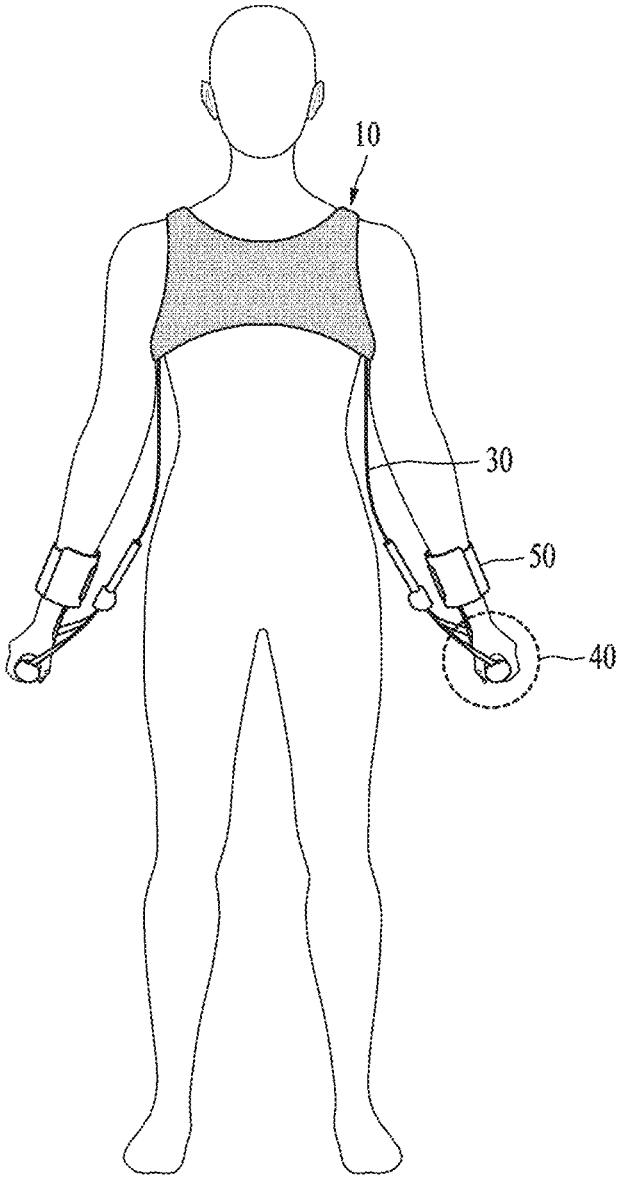
FIG. 1C illustrates a wearable device worn by a user according to an embodiment.

Referring to FIG. 1A to FIG. 1C, a wearable fitness device (hereafter, the wearable device 100) using a cable may be worn by a user. The user may perform various motions while wearing the wearable device 100. The user may perform strength training while wearing the wearable device 100. For example, the user may perform upper body exercises and/or lower body exercises while wearing the wearable device 100. For example, the user may perform various exercises such as weight training, boxing, Pilates, or yoga while wearing the wearable device 100. When the user exercises while wearing the wearable device 100, the appearance of the user may be displayed on a display. For example, various sensors provided in the wearable device 100 may detect the current posture of the user. The various sensors may transmit detected posture information to the display. The display may display the current appearance of the user based on the information received from the various sensors. For example, the display may be included in an electronic device connected by wire or wirelessly to the wearable device 100. For example, the electronic device may include a monitor, a television, a mobile terminal, a tablet, and an extended reality (XR) device.

FIG. 1A illustrates a wearable device to be worn on a body of a user according to an embodiment.

Referring to FIG. 1A, according to an embodiment, the wearable device 100 may include a wearable portion 10, a control system 20, a cable 30, a gripping part 40, and a wearable part 50.

The wearable portion 10 may be worn on the body of the user. For example, the wearable portion 10 may be worn on the upper body of the user. The wearable portion 10 may fit to the upper body of the user and support a portion of the upper body of the user. A base plate of the wearable portion 10 may be worn on the back of the user. For example, the base plate may have a flat plate shape. A front surface of the base plate may face the back of the user. A back surface of the base plate may face the control system 20 described below.

According to an embodiment, the control system 20 may adjust the magnitude of force applied to the user. The control system 20 may apply force to at least one of the one or more wearable parts worn by the user using the cable 30. The cable 30 may be an elastic cable or an inelastic cable. For example, the wearable part 50 may be worn on the wrist of the user. The control system 20 may adjust the exercise intensity of the user by adjusting the magnitude of force applied to the wearable part 50 through the cable 30. The control system 20 may detect an exercise performance of the user and readjust the exercise intensity in real time. For example, the control system 20 may readjust the exercise intensity based on the sensed heart rate of the user. For example, the control system 20 may readjust the exercise intensity based on the detected motion of a joint or muscle of the user or the muscle activation. The heart rate of the user and/or the joint movement may be detected by one or more body sensors in the control system 20. The control system 20 may receive sensing information from the one or more body sensors. For example, the control system 20 and the one or more body sensors may be connected by wire or wirelessly.

According to an embodiment, the control system 20 may determine an arm posture of the user. For example, the control system 20 may determine the arm posture by determining the posture of the upper arm and the posture of the lower arm of the user based on the length of the cable 30 and rotation information of the lower arm of the user. The rotation information of the lower arm may be generated by an inertial measurement unit (IMU) positioned in the wearable part 50. The method of determining the arm posture of the user will be described in detail below with reference to FIGS. 5 to 11.

According to an embodiment, one end of the cable 30 may be connected to the gripping part 40. The gripping part 40 may be in a shape that the user may hold in the palm using fingers so that the user may easily adjust the length of the cable 30, and the shape of the gripping part 40 is not limited to the described embodiments.

According to an embodiment, the wearable part 50 may allow one end of the cable 30 to be positioned closely to the body of the user even when the user does not hold the gripping part 40. For example, the wearable part 50 may include the IMU and a pulse sensor. The pulse sensor may sense the heart rate of the user.

In an embodiment of the wearable device 100 shown, the gripping part 40 and the wearable part 50 are shown to have separate shapes, but depending on embodiments, the gripping part 40 and the wearable part 50 may be manufactured to have one shape as an integral body.

FIG. 1B illustrates a configuration of a control system of a wearable device according to an embodiment.

Referring to FIG. 1B, the wearable device 100 may be controlled by the control system 20. The control system 20 may include at least one processor 102 comprising processing circuitry, memory 104, a communication module 106 comprising communication circuitry, a sensor module 108, an input module 110 comprising input circuitry, a sound output module 112 comprising output circuitry, and a cable drive module 114. In an embodiment, at least one (e.g., the sound output module 112) of these components may be omitted from the control system 20, or one or more other components (e.g., a haptic module) may be added thereto. Each "module" herein may comprise circuitry.

The cable drive module 114 may include a motor configured to generate power (e.g., torque) and/or a motor driver circuit configured to drive the motor. Each driving module herein may comprise a motor and/or circuitry.

Each "processor" herein includes processing circuitry, and/or may include multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The sensor module 108 may include a sensor circuit including at least one sensor. The sensor module 108 may include one or more sensors configured to generate motion information of the user or motion information of the wearable device 100. For example, the sensor module 108 may include an encoder configured to measure the length of the cable 30 of FIG. 1A. For example, the sensor module 108 may include a pulse sensor configured to measure the heart rate of the user. For example, the sensor module 108 may include an IMU configured to measure a motion of the upper body of the user. The IMU may sense X-axis, Y-axis, and Z-axis accelerations and X-axis, Y-axis, and Z-axis angular velocities according to a motion of the user. The IMU may be used to measure at least one of a forward and backward tilt, a left and right tilt, or a rotation of the body of the user. For example, the sensor module 108 may further include at least one of a position sensor configured to obtain a position value of the wearable device 100, a proximity sensor configured to sense the proximity of an object, a biometric sensor configured to detect a biosignal of the user, or a temperature sensor configured to measure an ambient temperature.

The input module 110 may receive a command or data to be used by a component (e.g., the processor 102) of the wearable device 100 from the outside (e.g., the user) of the wearable device 100. The input module 110 may include an input component circuit. The input module 110 may include, for example, a key (e.g., a button) or a touch screen.

The sound output module 112 may output a sound signal to the outside of the wearable device 100. The sound output module 112 may provide auditory feedback to the user. For example, the sound output module 112 may include a speaker configured to play back a guiding sound signal (e.g., an operation start sound, an operation error alarm, or an exercise start alarm), music content, or a guiding voice for auditorily informing predetermined information (e.g., exercise result information or exercise posture evaluation information).

In an embodiment, the control system 20 may further include a battery (not shown) configured to supply power to each component of the wearable device 100. The wearable device 100 may convert the power of the battery into power suitable for an operating voltage of each component of the wearable device 100 and supply the converted power to each component.

The cable drive module 114 may generate tension or torque to be applied to the cable 30 under the control of the processor 102. The cable drive module 114 may generate tension or torque to be applied to the cable 30 based on a control signal generated by the processor 102.

The at least one processor 102 may control the overall operation of the wearable device 100 and generate a control signal for controlling the components (e.g., the communication module 106 and the cable drive module 114).

The at least one processor 102 may execute, for example, software to control at least one other component (e.g., a hardware or software component) of the wearable device 100 connected, directly or indirectly, to the at least one processor 102, and may perform a variety of data processing or computation. The software may include an application for providing a graphical user interface (GUI). According to an embodiment, as at least part of data processing or computation, the processor 102 may store instructions or data received from another component (e.g., the communication module 106) in the memory 104, process the instructions or data stored in the memory 104, and store result data obtained as a result of processing in the memory 104. According to an embodiment, the processor 102 may include a main processor (e.g., a central processing unit (CPU) or an application processor (AP)) or an auxiliary processor (e.g., a graphics processing unit (GPU), a neural processing unit (NPU), an image signal processor (ISP), a sensor hub processor, or a communication processor (CP)) that is operable independently of, or in conjunction with the main processor. The auxiliary processor may be implemented separately from the main processor or as part of the main processor.

The memory 104 may store a variety of data used by the processor 102. The data may include, for example, software, sensor data, and input data or output data for instructions related thereto. The memory 104 may include a volatile memory or a non-volatile memory (e.g., a random-access memory (RAM), a dynamic RAM (DRAM), or a static RAM (SRAM)).

The communication module 106 may support the establishment of a direct (e.g., wired) communication channel or a wireless communication channel between the processor 102 and another component of the wearable device 100 or an external electronic device, and support the communication through the established communication channel. The communication module 106 may include a communication circuit configured to perform a communication function. For example, the communication module 106 may receive a control signal from an external electronic device and transmit the sensor data obtained by the sensor module 108 to the external electronic device. According to an embodiment, the communication module 106 may include one or more CPs (not shown) that are operable independently of the processor 102 and that support direct (e.g., wired) communication or wireless communication. According to an embodiment, the communication module 106 may include a wireless communication module (e.g., a cellular communication module, a short-range wireless communication module, or a global navigation satellite system (GNSS) communication module), and/or a wired communication module. A corresponding one of these communication modules may communicate with another component of the wearable device 100 and/or an external electronic device via a short-range communication network, such as Bluetooth™, wireless-fidelity (Wi-Fi), or infrared data association (IrDA), or a long-range communication network, such as a legacy cellular network, a 5G network, a next-generation communication network, the Internet, or a computer network (e.g., a local area network (LAN) or a wide area network (WAN)).

In an embodiment, the control system 20 may further include a haptic module (not shown). The haptic module may provide haptic feedback to the user under the control of the processor 102. The haptic module may convert an electrical signal into a mechanical stimulus (e.g., a vibration or a movement) or an electrical stimulus which may be recognized by the user via his or her tactile sensation or kinesthetic sensation. The haptic module may include a motor, a piezoelectric element, or an electrical stimulation device.

FIG. 1C illustrates a wearable device worn on a user according to an embodiment.

The wearable portion 10 of the wearable device 100 may be worn on the upper body of the user. When the wearable portion 10 is worn on the upper body of the user, the control system 20 may be placed on the back of the user. The gripping part 40 and the wearable part 50 of the wearable device 100 may be worn to be placed on the hand and wrist of the user. The length of the cable 30 (e.g., see cable 30 in FIG. 1A) may change according to a motion of the arm of the user. For example, when the wearable device 100 operates in a daily mode or a game mode, the tension of the cable 30 may be controlled to such an extent that a motion of the arm of the user may not be interfered. For example, when the wearable device 100 operates in an exercise mode, the tension of the cable 30 may be controlled according to an exercise intensity to provide external force to the user.

Figure 2:
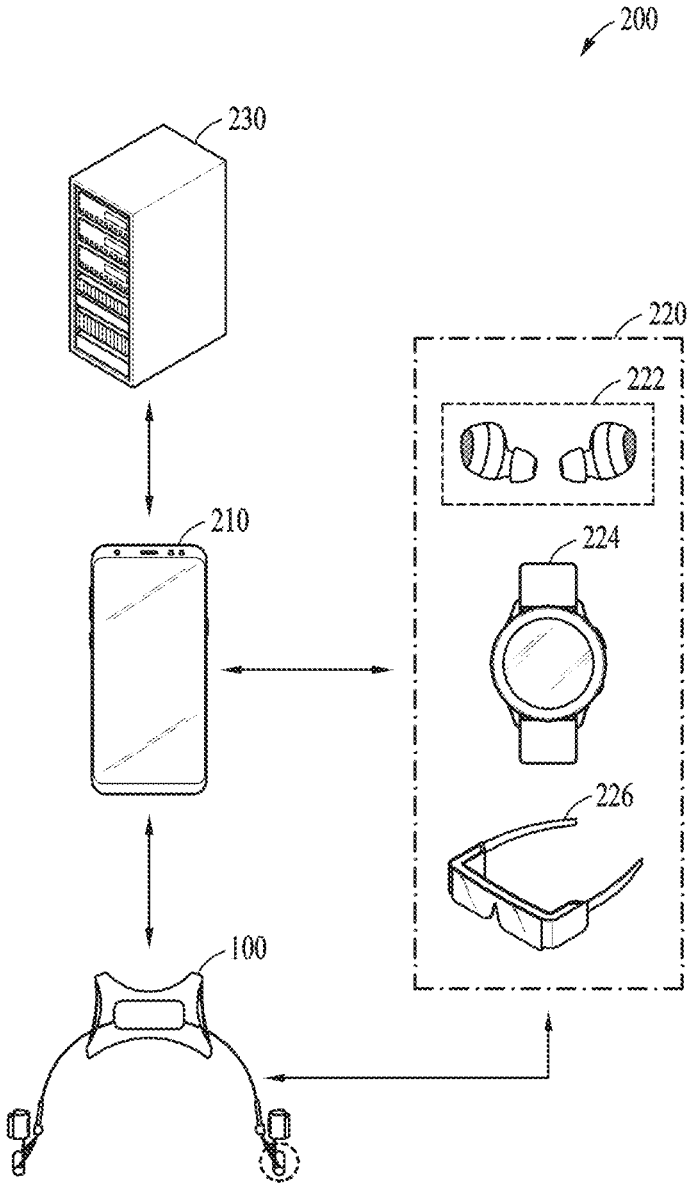
FIG. 2 is a diagram illustrating a system including a wearable device and an electronic device according to an example embodiment.

FIG. 2 is a diagram illustrating a system including a wearable device and an electronic device according to an embodiment.

Referring to FIG. 2, a system 200 may include the wearable device 100 to be worn on a body of a user, an electronic device 210, another wearable device 220, and a server 230. In an embodiment, at least one (e.g., the other wearable device 220 or the server 230) of these devices may be omitted from the system 200, or one or more other devices (e.g., an exclusive controller device of the wearable device 100) may be added thereto. The electronic device 210 may or may not be part of the wearable device 100.

In an embodiment, the wearable device 100 may be worn on the body of the user to sense a motion of the user. For example, the wearable device 100 may be worn on the upper body of the user to generate external force for an arm exercise of the user. For example, the wearable device 100 may be worn on the upper body of the user to determine a motion of the arm of the user.

In an embodiment, the wearable device 100 may generate a resistance force for hindering a body motion of the user and apply the resistance force to the user through the cable 30 to enhance the exercise effect of the user in an exercise mode. For example, the resistance force may be generated by a motor connected, directly or indirectly, to the cable 30.

The wearable device 100 may adjust the strength of the resistance force applied to the user according to an exercise intensity selected by the user. For example, the wearable device 100 may control the cable drive module 114 of FIG. 1B (which may comprise a motor and/or circuitry) to generate a resistance force corresponding to the exercise intensity selected by the user.

The electronic device 210 may communicate with the wearable device 100 and may remotely control the wearable device 100 or provide the user with state information about a state (e.g., a booting state, a charging state, a sensing state, or an error state) of the wearable device 100. The electronic device 210 may receive the sensor data obtained by a sensor in the wearable device 100 from the wearable device 100 and determine a motion of the user based on the received sensor data. In an embodiment, when the user moves wearing the wearable device 100, the wearable device 100 may obtain sensor data including motion information of the user using sensors and transmit the obtained sensor data to the electronic device 210. The electronic device 210 may determine a motion or posture of the user from the sensor data and evaluate an exercise posture of the user based on the determined motion or posture. The electronic device 210 may provide the user with an exercise posture measured value and exercise posture evaluation information related to the exercise posture of the user through a GUI.

In an embodiment, the electronic device 210 may execute a program (e.g., an application) configured to control the wearable device 100, and the user may adjust an operation of the wearable device 100, the magnitude of torque output, the volume of audio output from the sound output module 112, or the brightness of a lighting unit through the corresponding program. The program executed by the electronic device 210 may provide a GUI for interaction with the user. The electronic device 210 may be a device in various forms. For example, the electronic device 210 may include a portable communication device (e.g., a smart phone), a computer device, an access point, a portable multimedia device, or a home appliance (e.g., a television, an audio device, or a projector device), but is not limited thereto.

According to an embodiment, the electronic device 210 may be connected to the server 230 using short-range wireless communication or cellular communication. The server 230 may receive user profile information of the user who uses the wearable device 100 from the electronic device 210 and store and manage the received user profile information. The user profile information may include, for example, information about at least one of the name, age, gender, height, weight, or body mass index (BMI). The server 230 may receive exercise history information about an exercise performed by the user from the electronic device 210 and store and manage the received exercise history information. The server 230 may provide the electronic device 210 with various exercise programs or physical ability measurement programs that may be provided to the user.

According to an embodiment, the wearable device 100 and/or the electronic device 210 may be connected, directly or indirectly, to the other wearable device 220. The other wearable device 220 may include, for example, wireless earphones 222, a smart watch 224, or smart glasses 226, but is not limited thereto. In an embodiment, the smart watch 224 may generate biometric information including heart rate information of the user and rotation information of the part on which it is worn, and transmit the measured information to the electronic device 210 and/or the wearable device 100.

In an embodiment, the exercise result information, physical ability information, and/or exercise posture evaluation information evaluated by the electronic device 210 may be transmitted to the other wearable device 220 and provided to the user through the other wearable device 220. State information of the wearable device 100 may also be transmitted to the other wearable device 220 and provided to the user through the other wearable device 220. In an embodiment, the wearable device 100, the electronic device 210, and the other wearable device 220 may be connected to each other through wireless communication (e.g., Bluetooth communication or Wi-Fi communication).

In an embodiment, the wearable device 100 may provide (or output) feedback (e.g., visual feedback, auditory feedback, or haptic feedback) corresponding to the state of the wearable device 100 according to the control signal received from the electronic device 210. For example, the wearable device 100 may provide visual feedback through the lighting unit and provide auditory feedback through the sound output module 112. The wearable device 100 may include a haptic module and provide haptic feedback in the form of vibration to the body of the user through the haptic module. The electronic device 210 may also provide (or output) feedback (e.g., visual feedback, auditory feedback, or haptic feedback) corresponding to the state of the wearable device 100.

Figure 3:
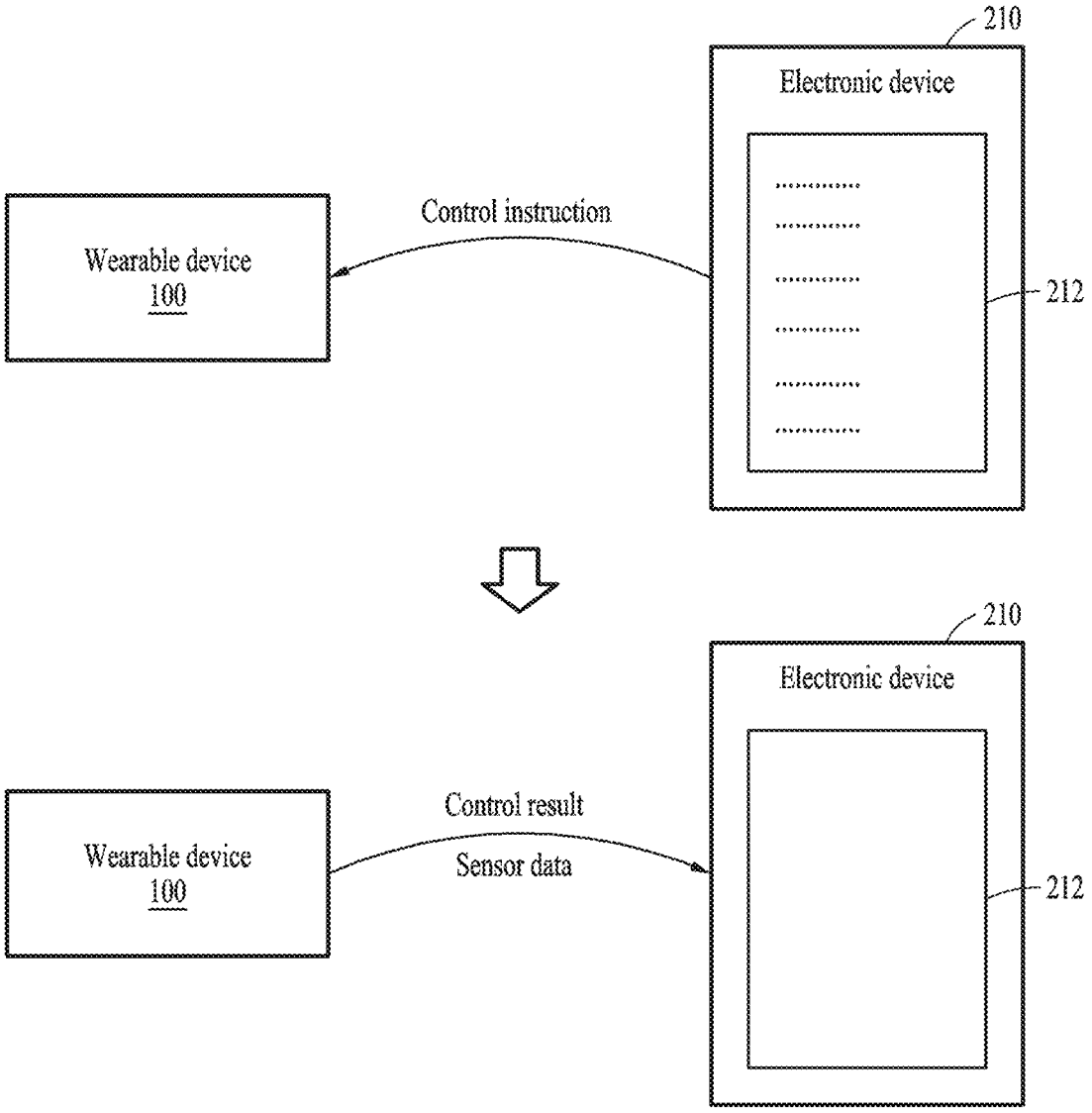
FIG. 3 is a diagram illustrating an interaction between a wearable device and an electronic device according to an example embodiment.

FIG. 3 is a diagram illustrating an interaction between a wearable device and an electronic device according to an embodiment.

Referring to FIG. 3, the wearable device 100 may communicate with the electronic device 210. For example, the electronic device 210 may be a user terminal of a user who uses the wearable device 100 or a controller device dedicated to the wearable device 100. In an embodiment, the wearable device 100 and the electronic device 210 may be connected to each other through short-range wireless communication (e.g., Bluetooth communication or Wi-Fi communication). The electronic device 210 may or may not be part of the wearable exercise device 100 in different example embodiments.

In an embodiment, the electronic device 210 may check a state of the wearable device 100 or execute an application to control or operate the wearable device 100. A screen of a user interface (UI) may be displayed to control an operation of the wearable device 100 or determine an operation mode of the wearable device 100 on a display 212 of the electronic device 210 through the execution of the application. The UI may be, for example, a GUI.

In an embodiment, the user may input an instruction to control the operation of the wearable device 100 or change settings of the wearable device 100 through the GUI screen on the display 212 of the electronic device 210. The electronic device 210 may generate a control instruction (or control signal) corresponding to an operation control instruction or a setting change instruction input by the user and transmit the generated control instruction to the wearable device 100. The wearable device 100 may operate according to the received control instruction and transmit a control result according to the control instruction and/or sensor data measured by the sensor module of the wearable device 100 to the electronic device 210. The electronic device 210 may provide the user with result information derived by analyzing the control result and/or the sensor data through the GUI screen.

Figure 4:
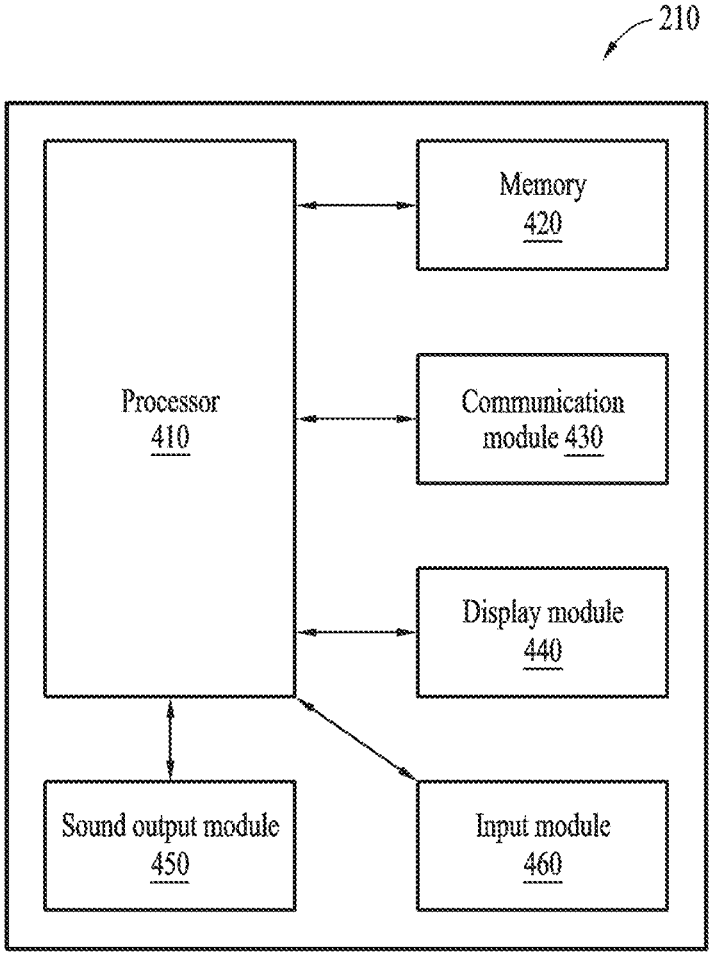
FIG. 4 is a diagram illustrating a configuration of an electronic device according to an example embodiment.

FIG. 4 is a diagram illustrating a configuration of an electronic device according to an embodiment.

Referring to FIG. 4, the electronic device 210 may include a processor 410, memory 420, a communication module 430, a display module 440, a sound output module 450, and an input module 460. In an embodiment, at least one (e.g., the sound output module 450) of these components may be omitted from the electronic device 210, or one or more other components (e.g., a sensor module and a battery) may be added thereto.

The processor 410 may control at least one other component (e.g., a hardware or software component) of the electronic device 210, and may perform a variety of data processing or computation. According to an embodiment, as at least part of data processing or computation, the processor 410 may store instructions or data received from another component (e.g., the communication module 430) in the memory 420, process the instructions or data stored in the memory 420, and store result data obtained as a result of processing in the memory 420.

According to an embodiment, the processor 410 may include a main processor (e.g., a CPU or an AP) or an auxiliary processor (e.g., a GPU), an NPU, an ISP, a sensor hub processor, or a CP) that is operable independently of, or in conjunction with the main processor.

The memory 420 may store a variety of data used by at least one component (e.g., the processor 410 or the communication module 430) of the electronic device 210. The data may include, for example, a program (e.g., an application), and input data or output data for instructions related thereto. The memory 420 may include at least one instruction executable by the processor 410. The memory 420 may include a volatile memory or a non-volatile memory.

The communication module 430 may support the establishment of a direct (e.g., wired) communication channel or a wireless communication channel between the electronic device 210 and another electronic device (e.g., the wearable device 100, the other wearable device 220, or the server 230), and support the communication through the established communication channel. The communication module 430 may include a communication circuit configured to perform a communication function. The communication module 430 may include one or more CPs that are operable independently of the processor 410 (e.g., an AP) and that support a direct (e.g., wired) communication or a wireless communication. According to an embodiment, the communication module 430 (comprising communication circuitry) may include a wireless communication module configured to perform wireless communication (e.g., a Bluetooth communication module, a cellular communication module, a Wi-Fi communication module, or a GNSS communication module) or a wired communication module (e.g., a LAN communication module or a power line communication (PLC) module). For example, the communication module 430 may transmit a control instruction to the wearable device 100 and receive, from the wearable device 100, at least one of sensor data including body motion information of the user who is wearing the wearable device 100, state data of the wearable device 100, or control result data corresponding to the control instruction.

The display module 440 may visually provide information to the outside (e.g., the user) of the electronic device 210. The display module 440 may include, for example, a liquid-crystal display (LCD) or organic light-emitting diode (OLED) display, a hologram device, or a projector device. The display module 440 may further include a control circuit configured to control the driving of a display. In an embodiment, the display module 440 may further include a touch sensor set to sense a touch or a pressure sensor set to sense the intensity of a force generated by the touch.

The sound output module 450 may output a sound signal to the outside of the electronic device 210. The sound output module 450 may include a speaker configured to play back a guiding sound signal (e.g., an operation start sound or an operation error alarm), music content, or a guiding voice based on the state of the wearable device 100. When it is determined that the wearable device 100 is not properly worn on the body of the user, the sound output module 450 may output a guiding voice for informing the user is wearing the wearable device 100 abnormally or for guiding the user to wear the wearable device 100 normally.

The input module 460 may receive a command or data to be used by a component (e.g., the processor 410) of the electronic device 210 from the outside (e.g., the user) of the electronic device 210. The input module 460 may include an input component circuit and may receive a user input. The input module 460 may include, for example, a key (e.g., a button) or a touch screen.

Figure 5:
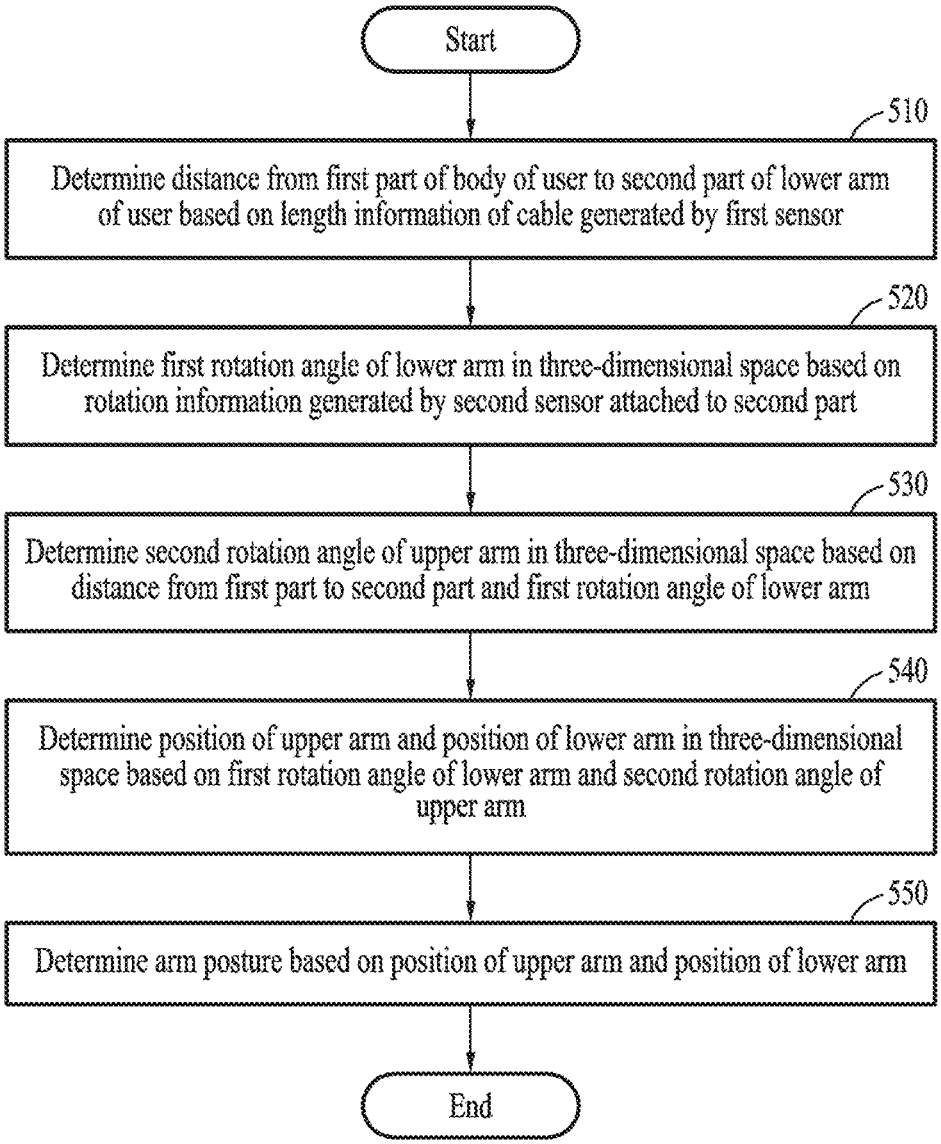
FIG. 5 is a flowchart illustrating a method of determining an arm posture according to an example embodiment.

FIG. 5 is a flowchart illustrating a method of determining an arm posture according to an embodiment.

Operations 510 to 550 described below may be performed by an electronic device (e.g., the wearable device 100 of FIGS. 1A-1B and/or the electronic device 210 of FIGS. 2, 3, and/or 4). For example, the electronic device may include at least one processor (e.g., the processor 102 of FIG. 1B and/or the processor 410 of FIG. 4), a communication module (e.g., the communication module 106 of FIG. 1B and/or the communication module 430 of FIG. 4), and memory (e.g., the memory 104 of FIG. 1B or the memory 420 of FIG. 4).

In operation 510, the processor of the electronic device may determine the distance from a first part of a body of a user to a second part of a lower arm of the user based on length information of a cable (e.g., the cable 30 of FIG. 1A) generated by a first sensor of a wearable device arranged on at least a part of the body of the user. For example, the first sensor may be an encoder connected, directly or indirectly, to the cable. For example, the first part may be a shoulder joint of the user. For example, the second part may correspond to a wrist joint.

According to an embodiment, the distance from the first part of the body of the user to the second part of the lower arm of the user may be calculated based on the initial length of the cable. One end of the cable may extend from the cable drive module 114 of the wearable device 100, and the cable drive module 114 may be placed on the back of the user. Due to the difference between the position of the cable drive module 114 and the position of the first part, the initial length of the cable measured by the encoder of the cable may differ from the distance from the first part of the body of the user to the second part of the lower arm of the user. The method of determining the distance from the first part of the body of the user to the second part of the lower arm of the user based on the initial length of the cable will be described in detail below with reference to FIG. 6.

In operation 520, the processor of the electronic device may determine a first rotation angle of the lower arm in a three-dimensional space based on rotation information generated by a second sensor attached to the second part of the lower arm. For example, the second sensor may be an IMU.

According to an embodiment, the user wearing the wearable device 100 may take a calibration posture. The wearable device 100 may guide the user to take a calibration posture. For example, the calibration posture may be a posture with the arms stretching out to the sides to be parallel with the horizontal plane, and the calibration posture is not limited to the described embodiments. When the user takes the calibration position correctly, the rotation information obtained by the second sensor may be obtained as reference rotation information. The processor of the electronic device may determine the first rotation angle of the lower arm based on the reference rotation information and target rotation information. The target rotation information may be current rotation information generated by the second sensor. For example, the first rotation angle may correspond to a variation between the reference rotation information and the target rotation information.

According to an embodiment, the first rotation angle of the lower arm may be determined based on rotation information generated by the IMU arranged in the gripping part 40 or the wearable part 50 of the wearable device 100. The electronic device may receive rotation information from the wearable device 100. If the electronic device is the wearable device 100, the electronic device may receive rotation information from the IMU.

In operation 530, the processor of the electronic device may determine a second rotation angle of an upper arm in the three-dimensional space based on the distance from the first part of the body to the second part of the lower arm and the first rotation angle of the lower arm.

The arm of the human body includes the upper arm connecting a shoulder joint and an elbow joint and the lower arm connecting the elbow joint and a wrist joint, and the upper arm and the lower arm move while being connected. Thus, the rotation angle of the upper arm with respect to the shoulder joint (hereinafter, referred to as the second rotation angle) may be calculated based on the first rotation angle of the wrist joint positioned in the lower arm and the distance between the shoulder joint and the wrist joint. The method of determining the second rotation angle of the upper arm will be described in detail below with reference to FIGS. 7 to 10.

In operation 540, the processor of the electronic device may determine a position of the upper arm and a position of the lower arm in the three-dimensional space based on the first rotation angle of the lower arm and the second rotation angle of the upper arm.

According to an embodiment, the processor of the electronic device may determine the position of the upper arm and the position of the upper arm based on the length of the upper arm, the first rotation angle of the lower arm, and the second rotation angle of the upper arm. For example, the processor of the electronic device may receive the length of the upper arm and the length of the lower arm in advance from the user. For example, the processor of the electronic device may calculate the length of the upper arm and the length of the lower arm of the user based on the length of the cable 30 obtained by requesting the user wearing the wearable device 100 to take a preset posture.

In operation 550, the processor of the electronic device may determine the arm posture based on the position of the upper arm and the position of the lower arm.

According to an embodiment, a determined arm posture may be used to determine whether the user performs an exercise normally. For example, when the user is required to stretch an arm forward, the processor of the electronic device may use a determined arm posture to determine whether the user actually stretched the arm.

Figure 6:
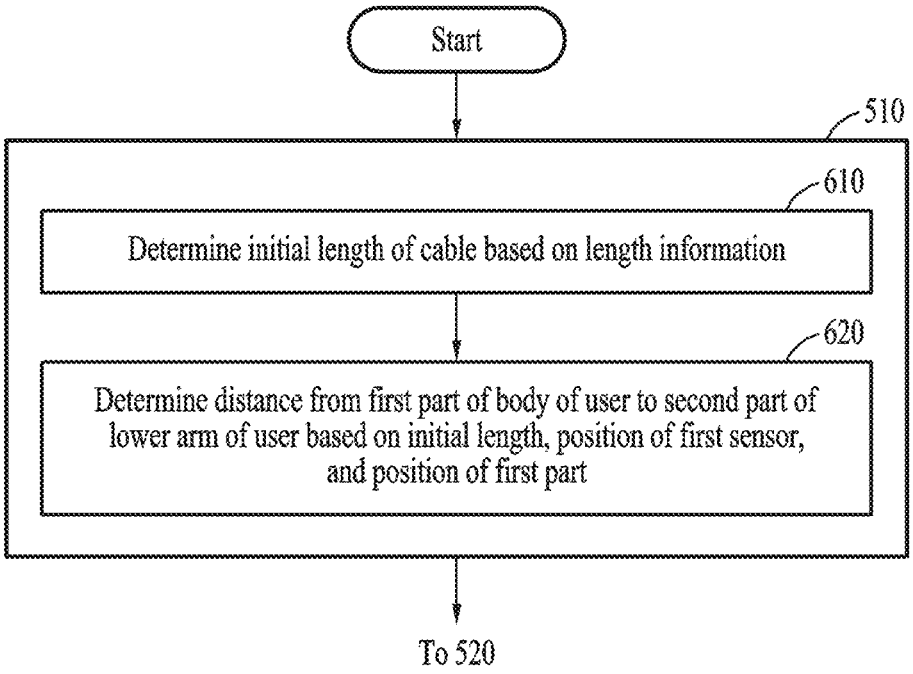
FIG. 6 is a flowchart illustrating a method of determining the distance from a first part of a body of a user to a second part of a lower arm of the user based on length information of a cable generated by a first sensor according to an example embodiment.

FIG. 6 is a flowchart illustrating a method of determining the distance from a first part of a body of a user to a second part of a lower arm of the user based on length information of a cable generated by a first sensor according to an embodiment.

According to an embodiment, operation 510 described above with reference to FIG. 5 may include operations 610 and 620 to be described hereinafter. Operations 610 and 620 may be performed by an electronic device (e.g., the wearable device 100 of FIG. 1B or the electronic device 210 of FIG. 4).

In operation 610, a processor of the electronic device may determine the initial length of the cable based on the length information. For example, the length information may be information indicating how much a rotating body (e.g., an axis of a motor) has rotated. The length of the cable may be adjusted as the rotating body rotates. For example, when the rotating body rotates in a first direction, at least a portion of the cable may be wound around the rotating body, and when the rotating body rotates in a second direction, at least a portion of the cable may be unwound from the rotating body.

In operation 620, the processor of the electronic device may determine the distance from the first part of the body of the user to the second part of the lower arm of the user based on the initial length of the cable, the position of the first sensor, and the position of the first part.

Since the initial length of the cable is the length based on the position of the first sensor, the initial length may be corrected in view of the difference between the position of the first sensor and the position of the first part. The corrected initial length may correspond to the distance from the first part to the second part.

According to an embodiment, the processor of the electronic device may determine the distance from the first part to the second part further using an IMU configured to measure a motion of the upper body of the user. For example, when the user tilts the upper body forward, the degree of the forward movement of the position of the first part is greater than the degree of the forward movement of the position of the first sensor. Thus, the initial length of the cable may increase even when the distance from the first part to the second part is maintained the same. For example, when the user tilts the upper body backward, the degree of the backward movement of the position of the first part is greater than the degree of the backward movement of the position of the first sensor. Thus, the initial length of the cable may decrease even when the distance from the first part to the second part is maintained the same. In the above cases, the processor of the electronic device may correct the initial length further using the degree of the movement of the upper body measured by the IMU.

Figure 7:
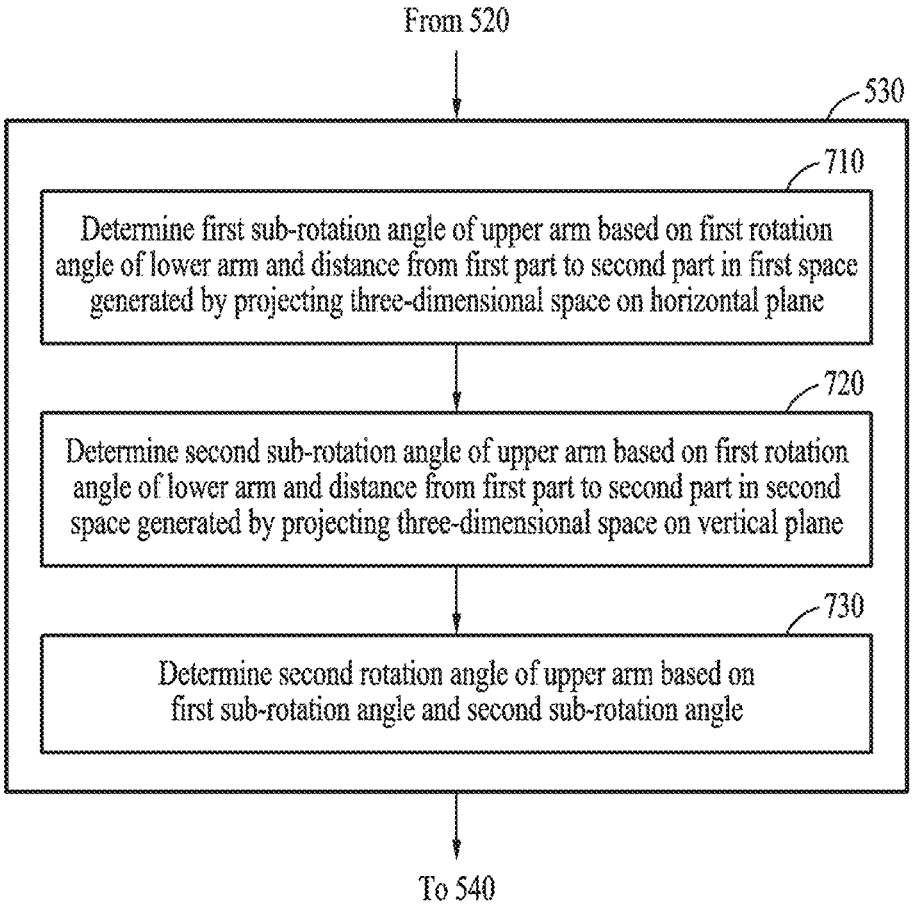
FIG. 7 is a flowchart illustrating a method of determining a second rotation angle of an upper arm in a three-dimensional (3D) space based on the distance from a first part to a second part and a first rotation angle of a lower arm according to an example embodiment.

FIG. 7 is a flowchart illustrating a method of determining a second rotation angle of an upper arm in a three-dimensional space based on the distance from a first part to a second part and a first rotation angle of a lower arm according to an embodiment.

According to an embodiment, operation 530 described above with reference to FIG. 5 may include operations 710 to 730 to be described hereinafter. Operations 710 to 730 may be performed by an electronic device (e.g., the wearable device 100 of FIGS. 1A-1B and/or the electronic device 210 of FIGS. 2-4).

In operation 710, a processor of the electronic device may determine a first sub-rotation angle of the upper arm based on the first rotation angle of the lower arm and the distance from the first part to the second part in a first space generated by projecting the three-dimensional space on a horizontal plane.

According to an embodiment, in the three-dimensional space, the x-axis may be an axis passing through both shoulder joints of the user, the y-axis may be an axis passing through the front surface and the rear surface of the user, and the z-axis may be an axis perpendicular to the ground. The first space may be a space in which z-axis values are projected onto the x-y plane. For example, the right shoulder joint of the user may correspond to the first part of the body of the user. For example, the first sub-rotation angle of the upper arm may be the angle of the upper arm with respect to the x-axis appearing on the x-y plane. The first space will be described in detail below with reference to FIG. 8A.

In operation 720, the processor of the electronic device may determine a second sub-rotation angle of the upper arm based on the first rotation angle of the lower arm and the distance from the first part to the second part in a second space generated by projecting the three-dimensional space on a vertical plane.

The second space may be a space in which x-axis values are projected onto the y-z plane. For example, the second sub-rotation angle of the upper arm may be the angle of the upper arm with respect to the y-axis appearing on the y-z plane. The second space will be described in detail below with reference to FIG. 8B.

In operation 730, the processor of the electronic device may determine the second rotation angle of the upper arm based on the first sub-rotation angle and the second sub-rotation angle. Since the first sub-rotation angle is the angle of the upper arm with respect to the x-axis appearing on the x-y plane, and the second sub-rotation angle is the angle of the upper arm with respect to the y-axis appearing on the y-z plane, the second rotation angle of the upper arm in the three-dimensional space may be determined based on the first sub-rotation angle and the second sub-rotation angle.

Figure 8A:
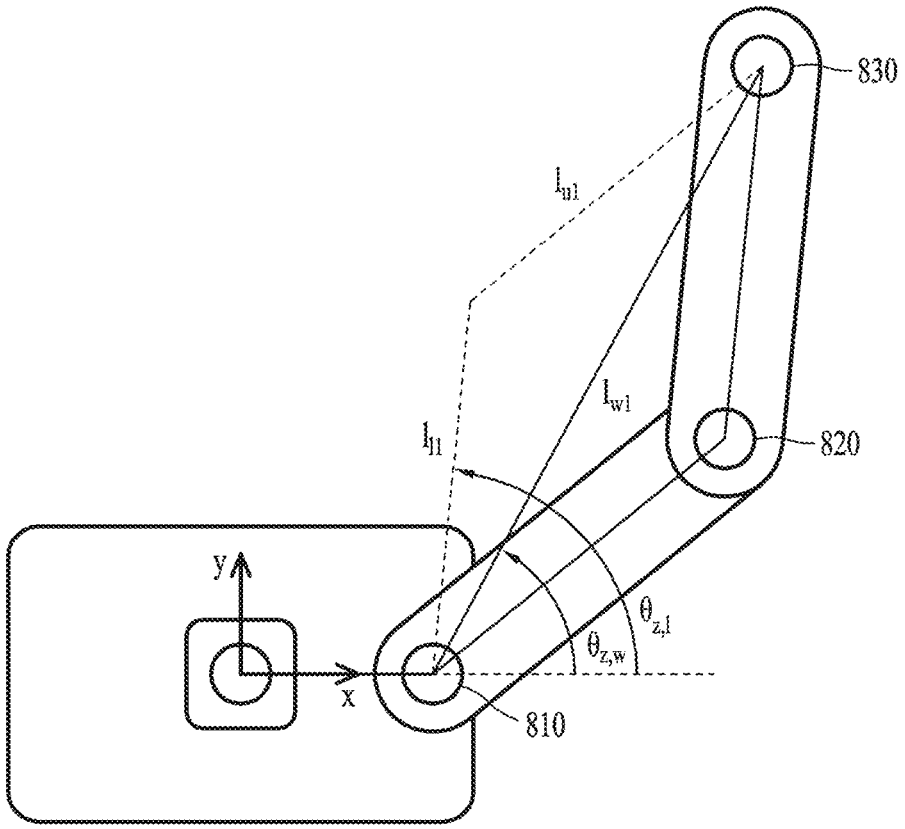
FIG. 8A illustrates a cable and the position of an arm represented in a first space generated by projecting a three-dimensional space on a horizontal plane according to an example embodiment.

FIG. 8A illustrates a cable and the position of an arm represented in a first space generated by projecting a three-dimensional space on a horizontal plane according to an embodiment.

According to an embodiment, a first part 810 of a body may correspond to the shoulder joint of a user, a third part 820 may correspond to the elbow joint of the user, and a second part 830 of a lower arm may correspond to the wrist joint of the user. The upper arm may include the first part 810 and the third part 820, and the lower arm may include the third part 820 and the second part 830.

An arm posture of the user may be modeled through a triangle formed by the length $l_{l1}$ of the lower arm, the length $l_{u1}$ of the upper arm, and the distance $l_{w1}$ from the first part 810 to the second part 830 in the first space.

According to an embodiment, the length $l_l$ of the lower arm, the length $l_u$ of the upper arm, and the distance $l_w$ from the first part to the second part in the three-dimensional space may differ from the length $l_{l1}$ of the lower arm, the length $l_{u1}$ of the upper arm, and the distance $l_{w1}$ from the first part 810 to the second part 830 in the first space, respectively. However, since it is impossible to perfectly calculate the length $l_{l1}$ of the lower arm, the length $l_{u1}$ of the upper arm, and the distance $l_{w1}$ in the first space with only the information currently obtained by the electronic device, the length $l_l$ of the lower arm, the length $l_u$ of the upper arm, and the distance $l_w$ may be used as approximate values of the length $l_{l1}$ of the lower arm, the length $l_{u1}$ of the upper arm, and the distance $l_{w1}$.

According to an embodiment, an electronic device (e.g., the wearable device 100 of FIGS. 1A-1B and/or the electronic device 210 of FIGS. 2-4) may determine the first sub-rotation angle $\theta_{z,\ w}$ of the upper arm using at least Equation 1 below.

$$\cos(\theta_{z,l} - \theta_{z,w}) = \frac{\overline{l_{l1}^2} + \overline{l_{w1}^2} - \overline{l'^2_{u1}}}{2 * \overline{l_{l1}} * \overline{l_{w1}}} \quad \text{[Equation 1]}$$

$$\theta_{z,w} = \theta_{z,l} - a\cos\left(\frac{\overline{l_{l1}^2} + \overline{l_{w1}^2} - \overline{l'^2_{u1}}}{2 * \overline{l_{l1}} * \overline{l_{w1}}}\right)$$

In Equation 1, $\theta_{z,\ l}$ may be the angle of the lower arm with respect to the x-axis appearing on the x-y plane, and $\theta_{z,\ l}$ may be obtained based on the first rotation angle of the lower arm in the three-dimensional space.

In Equation 1, $\overline{l_{u1}'}$ may be a corrected length of the length $l_u$ of the upper arm to improve the accuracy of the first sub-rotation angle $\theta_{z,\ w}$ calculated. For example, $\overline{l_{u1}'}$ may be determined in inverse proportion to the distance $l_{w1}$. For example, $\overline{l_{u1}'}$ may be calculated using Equation 2 below.

$$\overline{l'_{u1}} = \left(1 - 0.5 * \left(1 - \frac{\overline{l_{w1}}}{\overline{l_{u1}} + \overline{l_{l1}}}\right) * \cos(\theta_{x,l})\right) * \overline{l_{u1}} \quad \text{[Equation 2]}$$

In Equation 2, $\theta_{x,l}$ may be the angle of the lower arm with respect to the y-axis appearing on the y-z plane, which will be described below with reference to FIG. 8B, and $\theta_{x,l}$ may be obtained based on the first rotation angle of the lower arm in the three-dimensional space.

Figure 8B:
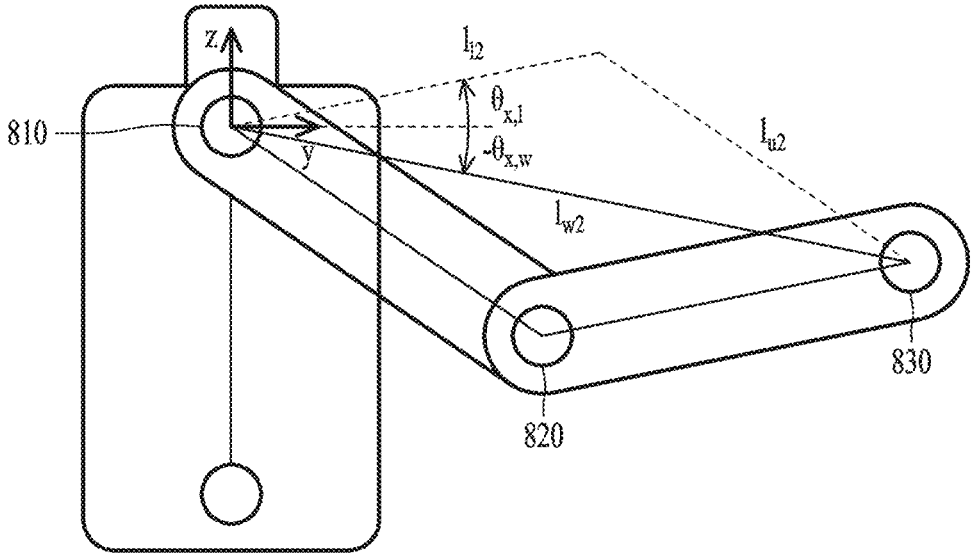
FIG. 8B illustrates a cable and the position of an arm represented in a second space generated by projecting a three-dimensional space on a vertical plane according to an example embodiment.

FIG. 8B illustrates a cable and the position of an arm represented in a second space generated by projecting a three-dimensional space on a vertical plane according to an embodiment.

An arm posture of the user may be modeled through a triangle formed by the length $l_{l2}$ of the lower arm, the length $l_{u2}$ of the upper arm, and the distance $l_{w2}$ from the first part 810 to the second part 830 in the second space.

According to an embodiment, the length $l_l$ of the lower arm, the length $l_u$ of the upper arm, and the distance $l_w$ from the first part 810 to the second part 830 in the three-dimensional space may differ from the length $l_{l2}$ of the lower arm, the length $l_{u2}$ of the upper arm, and the distance $l_{w2}$ from the first part 810 to the second part 830 in the second space, respectively. However, since it is impossible to perfectly calculate the length $l_{l2}$ of the lower arm, the length $l_{u2}$ of the upper arm, and the distance $l_{w2}$ in the second space with only the information currently obtained by the electronic device, the length $l_l$ of the lower arm, the length $l_u$ of the upper arm, and the distance $l_w$ may be used as approximate values of the length $l_{l2}$ of the lower arm, the length $l_{u2}$ of the upper arm, and the distance $l_{w2}$.

According to an embodiment, an electronic device (e.g., the wearable device 100 of FIGS. 1A-1B and/or the electronic device 210 of FIGS. 2-4) may determine the second sub-rotation angle $\theta_{x,\ w}$ of the upper arm using at least Equation 3 below.

$$\cos(\theta_{x,l} - \theta_{x,w}) = \frac{\overline{l_{l2}^2} + \overline{l_{w2}^2} - \overline{l'^2_{u2}}}{2 * \overline{l_l'} * \overline{l_w}} \quad \text{[Equation 3]}$$

$$\theta_{x,w} = \theta_{x,l} - a\cos\left(\frac{\overline{l_{l2}^2} + \overline{l_{w2}^2} - \overline{l'^2_{u2}}}{2 * \overline{l_{l2}'} * \overline{l_{w2}}}\right)$$

In Equation 3, $\theta_{x,\ l}$ may be the angle of the lower arm with respect to the y-axis appearing on the y-z plane, and $\theta_{x,\ l}$ may be obtained based on the first rotation angle of the lower arm in the three-dimensional space.

In Equation 3, $\overline{l_{u2}'}$ may be a corrected length of the length $l_u$ of the upper arm to improve the accuracy of the second sub-rotation angle $\theta_{x,\ w}$ calculated. For example, $\overline{l_{u2}'}$ may be determined in inverse proportion to the difference between $\theta_{z,\ l}$ and $\theta_{z,w}$. For example, $\overline{l_{u2}'}$ may be calculated using Equation 4 below.

$$\overline{l'_{u2}} = \cos(\theta_{z,l} - \theta_{z,w}) * \overline{l_{u2}} \quad \text{[Equation 4]}$$

In Equation 3, $\overline{l_{l2}'}$ may be a corrected length of the length $l_{l2}$ of the lower arm to improve the accuracy of the second sub-rotation angle $\theta_{x,\ w}$ calculated. For example, $\overline{l_{l2}'}$ may be determined in inverse proportion to the difference between $\theta_{z,l}$ and $\theta_{z,w}$. For example, $\overline{l_{l2}'}$ may be calculated using Equation 5 below.

$$\overline{l_{l2}'} = \cos(\theta_{z,l} - \theta_{z,w}) * \overline{l_{l2}} \quad \text{[Equation 5]}$$

Figure 9:
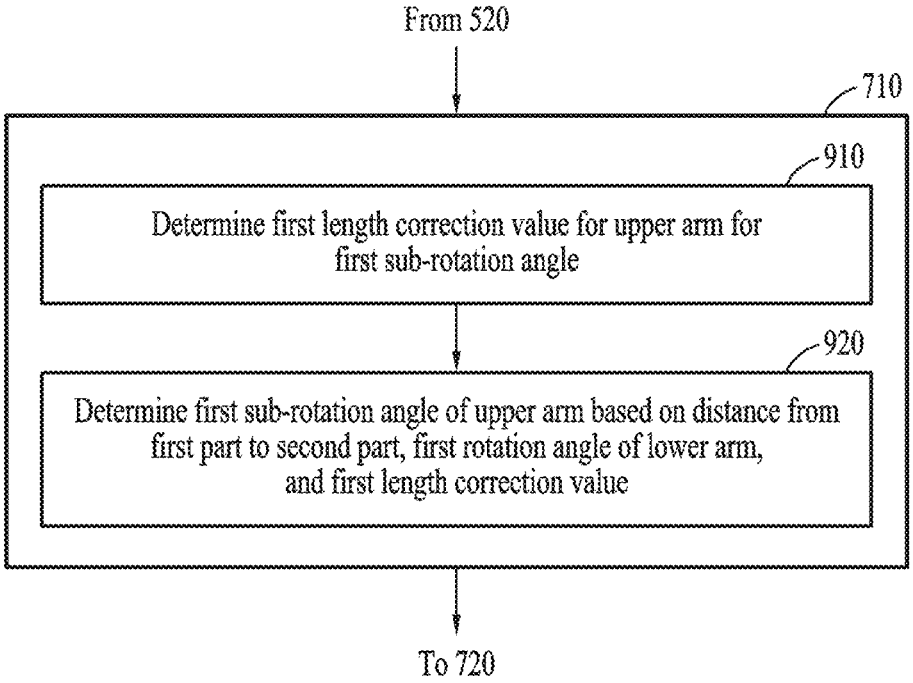
FIG. 9 is a flowchart illustrating a method of determining a first sub-rotation angle of an upper arm based on a first rotation angle of a lower arm and the distance from a first part to a second part in a first space generated by projecting a three-dimensional space on a horizontal plane according to an example embodiment.

FIG. 9 is a flowchart illustrating a method of determining a first sub-rotation angle of an upper arm based on a first rotation angle of a lower arm and the distance from a first part to a second part in a first space generated by projecting a three-dimensional space on a horizontal plane according to an embodiment.

According to an embodiment, operation 710 described above with reference to FIG. 7 may include operations 910 and 920 to be described hereinafter. Operations 910 and 920 may be performed by an electronic device (e.g., the wearable device 100 of FIGS. 1A-1B and/or the electronic device 210 of FIGS. 2-4).

In operation 910, a processor of the electronic device may determine a first length correction value for the upper arm for the first sub-rotation angle. For example, the first length correction value may be calculated to decrease as the distance from the first part to the second part increases. For example, the first length correction value for the upper arm may be $\overline{l_{u1}'}$ described above with reference to FIG. 8A.

In operation 920, the processor of the electronic device may determine the first sub-rotation angle of the upper arm based on the distance from the first part of the body to the second part of the lower arm, the first rotation angle of the lower arm, and the first length correction value.

Figure 10:
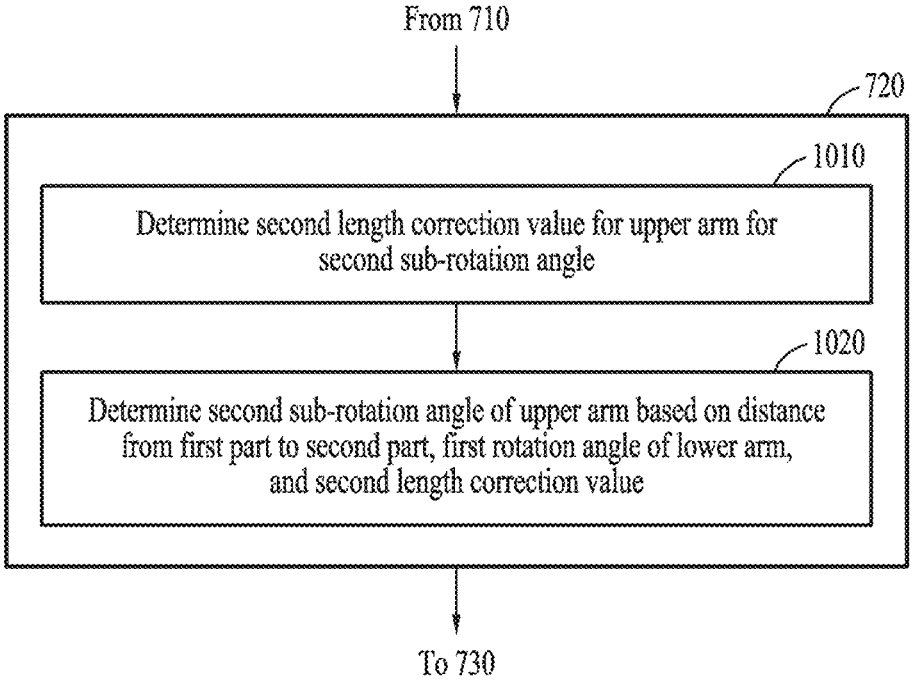
FIG. 10 is a flowchart illustrating a method of determining a second sub-rotation angle of an upper arm based on a first rotation angle of a lower arm and the distance from a first part to a second part in a second space generated by projecting a three-dimensional space on a vertical plane according to an example embodiment.

FIG. 10 is a flowchart illustrating a method of determining a second sub-rotation angle of an upper arm based on a first rotation angle of a lower arm and the distance from a first part to a second part in a second space generated by projecting a three-dimensional space on a vertical plane according to an embodiment.

According to an embodiment, operation 720 described above with reference to FIG. 7 may include operations 1010 and 1020 to be described hereinafter. Operations 1010 and 1020 may be performed by an electronic device (e.g., the wearable device 100 of FIGS. 1A-1B and/or the electronic device 210 of FIGS. 2-4).

In operation 1010, a processor of the electronic device may determine a second length correction value for the upper arm for the second sub-rotation angle. For example, the second length correction value may be calculated to decrease as a difference between the first rotation angle and the first sub-rotation angle in a first space generated by projecting the three-dimensional space on a horizontal plane increases. For example, the second length correction value for the upper arm may be $\overline{l_{u2}'}$ described above with reference to FIG. 8B.

The processor of the electronic device may further determine a length correction value for the lower arm for the second sub-rotation angle. For example, the length correction value for the lower arm may be $\overline{l_{l2}'}$ described above with reference to FIG. 8B.

In operation 1020, the processor of the electronic device may determine the second sub-rotation angle of the upper arm based on the distance from the first part to the second part, the first rotation angle of the lower arm, and the second length correction value. For example, the processor of the electronic device may further use the length correction value for the lower arm to determine the second sub-rotation angle of the upper arm.

Figure 11:
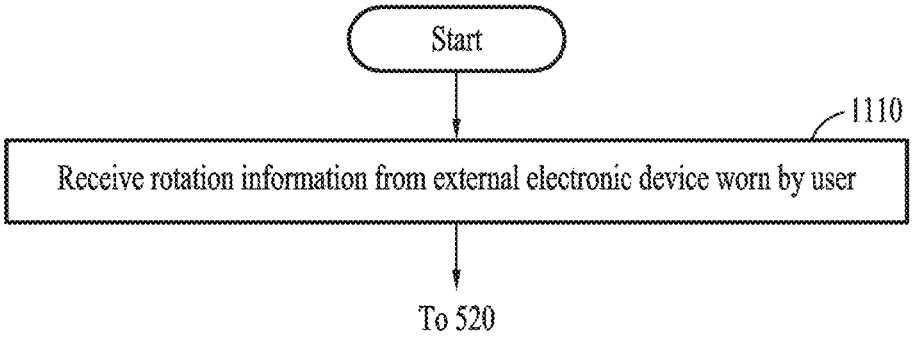
FIG. 11 is a flowchart illustrating a method of receiving rotation information from an external electronic device according to an example embodiment.

FIG. 11 is a flowchart illustrating a method of receiving rotation information from an external electronic device according to an embodiment.

According to an embodiment, operation 1110 to be described below may be further performed before operation 520 described above with reference to FIG. 5 is performed. Operation 1110 may be performed by an electronic device (e.g., the wearable device 100 of FIGS. 1A-1B and/or the electronic device 210 of FIGS. 2-4).

In operation 1110, a processor of the electronic device may receive rotation information from an external electronic device worn by a user. For example, the external electronic device may be the smart watch 224 described above with reference to FIG. 2.

If the electronic device can receive rotation information from the smart watch 224, an IMU may not be arranged in the gripping part 40 or the wearable part 50 of the wearable device 100.

According to an embodiment, an electronic device (e.g., 100 and/or 210) may include at least one processor 102, 410, and memory 104, 420 storing instructions that when executed by the at least one processor individually and/or collectively, cause the electronic device to at least determine (e.g., 510) a distance from a first part of a body of a user to a second part of a lower arm of the user based on length information of a cable generated by a first sensor arranged on at least a part of the body of the user, determine (e.g., 520) a first rotation angle of the lower arm in a three-dimensional space based on rotation information generated by a second sensor attached to the second part, determine (e.g., 530) a second rotation angle of an upper arm in the three-dimensional space based on the distance from the first part to the second part and the first rotation angle of the lower arm, determine (e.g., 540) a position of the upper arm and a position of the lower arm in the three-dimensional space based on the first rotation angle of the lower arm and the second rotation angle of the upper arm, and determine (e.g., 550) an arm posture of the user based on the position of the upper arm and the position of the lower arm.

"Based on" as used herein covers based at least one.

Each embodiment herein may be used in combination with any other embodiment(s) described herein.

According to an embodiment, when executed by the processor, the instructions may cause the electronic device to at least determine (e.g., 610) an initial length of the cable based on the length information, and determine (e.g., 620) the distance from the first part of the body of the user to the second part of the lower arm of the user based on the initial length, a position of the first sensor, and a position of the first part.

According to an embodiment, when executed by the processor, the instructions may cause the electronic device to at least determine the first rotation angle of the lower arm based on reference rotation information obtained by the second sensor and the rotation information, when the arm posture is a calibration posture.

According to an embodiment, the calibration posture may be a predesignated posture.

According to an embodiment, when executed by the processor, the instructions may cause the electronic device to at least determine (e.g., 710) a first sub-rotation angle of the upper arm based on the first rotation angle of the lower arm and the distance from the first part to the second part in a first space generated by projecting the three-dimensional space on a horizontal plane, determine (e.g., 720) a second sub-rotation angle of the upper arm based on the first rotation angle of the lower arm and the distance from the first part to the second part in a second space generated by projecting the three-dimensional space on a vertical plane, and determine (e.g., 730) the second rotation angle of the upper arm based on the first sub-rotation angle and the second sub-rotation angle.

According to an embodiment, when executed by the processor, the instructions may cause the electronic device to at least determine (e.g., 910) a first length correction value for the upper arm for the first sub-rotation angle, and determine (e.g., 920) the first sub-rotation angle of the upper arm based on the distance from the first part to the second part, the first rotation angle of the lower arm, and the first length correction value.

According to an embodiment, the first length correction value may be calculated to decrease as the distance from the first part to the second part increases.

According to an embodiment, when executed by the processor, the instructions may cause the electronic device to at least determine (e.g., 1010) a second length correction value for the upper arm for the second sub-rotation angle, and determine (e.g., 1020) the second sub-rotation angle of the upper arm based on the distance from the first part to the second part, the first rotation angle of the lower arm, and the second length correction value.

According to an embodiment, the second length correction value may be calculated to decrease as a difference between the first rotation angle and the first sub-rotation angle in a first space generated by projecting the three-dimensional space on a horizontal plane increases.

According to an embodiment, the first part of the body may correspond to a shoulder joint of the user, the second part of the lower arm may correspond to a wrist joint of the user, and the second rotation angle of the upper arm may represent a rotation angle of the upper arm with respect to the shoulder joint.

According to an embodiment, the electronic device may further include the first sensor, and the second sensor.

According to an embodiment, when executed by the processor, the instructions may cause the electronic device to at least receive the rotation information from an external electronic device 224 worn by the user through a communication module 106, 430 of the electronic device.

According to an embodiment, a method of determining an arm posture of a user includes determining (510) a distance from a first part of a body of the user to a second part of a lower arm of the user based on length information of a cable generated by a first sensor arranged on at least a part of the body of the user, determining (e.g., 520) a first rotation angle of the lower arm in a three-dimensional space based on rotation information generated by a second sensor attached to the second part, determining (e.g., 530) a second rotation angle of an upper arm in the three-dimensional space based on the distance from the first part to the second part and the first rotation angle of the lower arm, determining (e.g., 540) a position of the upper arm and a position of the lower arm in the three-dimensional space based on the first rotation angle of the lower arm and the second rotation angle of the upper arm, and determining (e.g., 550) the arm posture based on the position of the upper arm and the position of the lower arm.

According to an embodiment, a wearable device 100 may include a first sensor connected, directly or indirectly, to a cable 30, a processor 102, and memory 104 configured to store instructions executable by the processor, wherein when executed by the processor, the instructions may cause the electronic device to at least determine (e.g., 510) a distance from a first part of a body of a user to a second part of a lower arm of the user based on length information of the cable generated by the first sensor arranged on at least a part of the body of the user, determine (e.g., 520) a first rotation angle of the lower arm in a three-dimensional space based on rotation information generated by a second sensor attached to the second part, determine (e.g., 530) a second rotation angle of an upper arm in the three-dimensional space based on the distance from the first part to the second part and the first rotation angle of the lower arm, determine (e.g., 540) a position of the upper arm and a position of the lower arm in the three-dimensional space based on the first rotation angle of the lower arm and the second rotation angle of the upper arm, and determine (e.g., 550) an arm posture of the user based on the position of the upper arm and the position of the lower arm.

According to an embodiment, when executed by the processor, the instructions may cause the wearable device to at least determine (e.g., 610) an initial length of the cable based on the length information, and determine (e.g., 620) the distance from the first part of the body of the user to the second part of the lower arm of the user based on the initial length, a position of the first sensor, and a position of the first part.

According to an embodiment, when executed by the processor, the instructions may cause the wearable device to at least determine the first rotation angle of the lower arm based on reference rotation information obtained by the second sensor and the rotation information, when the arm posture is a calibration posture.

According to an embodiment, when executed by the processor, the instructions may cause the wearable device to at least determine (e.g., 710) a first sub-rotation angle of the upper arm based on the first rotation angle of the lower arm and the distance from the first part to the second part in a first space generated by projecting the three-dimensional space on a horizontal plane, determine (e.g., 720) a second sub-rotation angle of the upper arm based on the first rotation angle of the lower arm and the distance from the first part to the second part in a second space generated by projecting the three-dimensional space on a vertical plane, and determine (e.g., 730) the second rotation angle of the upper arm based on the first sub-rotation angle and the second sub-rotation angle.

According to an embodiment, when executed by the processor, the instructions may cause the wearable device to at least determine (e.g., 910) a first length correction value for the upper arm for the first sub-rotation angle, and determine (e.g., 920) the first sub-rotation angle of the upper arm based on the distance from the first part to the second part, the first rotation angle of the lower arm, and the first length correction value.

According to an embodiment, the first length correction value may be calculated to decrease as the distance from the first part to the second part increases.

According to an embodiment, the wearable device may further include the second sensor.

The embodiments described herein may be implemented using a hardware component, a software component and/or a combination thereof. A processing device may be implemented using one or more general-purpose or special-purpose computers, such as, for example, a processor, a controller and an arithmetic logic unit (ALU), a DSP, a microcomputer, a field-programmable gate array (FPGA), a programmable logic unit (PLU), a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciate that a processing device may include multiple processing elements and multiple types of processing elements. For example, the processing device may include a plurality of processors, or a single processor and a single controller. In addition, different processing configurations are possible, such as parallel processors.

The software may include a computer program, a piece of code, an instruction, or some combination thereof, to independently or uniformly instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network-coupled computer systems so that the software is stored and executed in a distributed fashion. The software and data may be stored by one or more non-transitory computer-readable recording mediums.

The methods according to the above-described embodiments may be recorded in non-transitory computer-readable media including program instructions to implement various operations of the above-described embodiments. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher-level code that may be executed by the computer using an interpreter.

The above-described devices may be configured to act as one or more software modules in order to perform the operations of the above-described examples, or vice versa.

As described above, although the embodiments have been described with reference to the limited drawings, a person skilled in the art may apply various technical modifications and variations based thereon. For example, suitable results may be achieved if the described techniques are performed in a different order and/or if components in a described system, architecture, device, or circuit are combined in a different manner and/or replaced or supplemented by other components or their equivalents. While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

Accordingly, other implementations are within the scope of the following claims.

What is claimed is:

1. An electronic device comprising:

a cable;

a first sensor configured to be disposed proximate at least a part of a body of a user and configured to generate length information of the cable;

a second sensor configured to be disposed proximate to a second part of a lower arm of the body of the user and configured to generate rotation information of the lower arm;

at least one processor comprising processing circuitry; and memory storing instructions that when executed by the at least one processor individually and/or collectively, cause the electronic device to at least:

determine a distance from a first part of the body of the user to the second part of the lower arm of the user based on the length information of the cable generated by the first sensor, determine a first rotation angle of the lower arm in a three-dimensional space based on the rotation information generated by the second sensor, determine a second rotation angle of an upper arm in the three-dimensional space based on the distance from the first part to the second part and the first rotation angle of the lower arm, determine a position of the upper arm and a position of the lower arm in the three-dimensional space based on the first rotation angle of the lower arm and the second rotation angle of the upper arm, determine an arm posture of the user based on the position of the upper arm and the position of the lower arm, and generate display information for displaying on a display a current appearance of the user based on the determined arm posture.

2. The electronic device of claim 1, wherein when executed by the at least one processor individually and/or collectively, the instructions cause the electronic device to at least:

determine an initial length of the cable based on the length information, and determine the distance from the first part of the body of the user to the second part of the lower arm of the user based on the initial length, a position of the first sensor, and a position of the first part.

3. The electronic device of claim 1, wherein when executed by the at least one processor individually and/or collectively, the instructions cause the electronic device to at least:

determine the first rotation angle of the lower arm based on reference rotation information obtained by the second sensor and the rotation information, when the arm posture is a calibration posture.

4. The electronic device of claim 3, wherein the calibration posture is a predesignated posture.

5. The electronic device of claim 1, wherein when executed by the at least one processor individually and/or collectively, the instructions cause the electronic device to at least:

determine a first sub-rotation angle of the upper arm based on the first rotation angle of the lower arm and the distance from the first part to the second part in a first space generated by projecting the three-dimensional space on a horizontal plane, determine a second sub-rotation angle of the upper arm based on the first rotation angle of the lower arm and the distance from the first part to the second part in a second space generated by projecting the three-dimensional space on a vertical plane, and determine the second rotation angle of the upper arm based on the first sub-rotation angle and the second sub-rotation angle.

6. The electronic device of claim 5, wherein when executed by the at least one processor individually and/or collectively, the instructions cause the electronic device to at least:

determine a first length correction value for the upper arm for the first sub-rotation angle, and determine the first sub-rotation angle of the upper arm based on the distance from the first part to the second part, the first rotation angle of the lower arm, and the first length correction value.

7. The electronic device of claim 6, wherein the first length correction value is calculated to decrease as the distance from the first part to the second part increases.

8. The electronic device of claim 5, wherein when executed by the at least one processor individually and/or collectively, the instructions cause the electronic device to at least:

determine a second length correction value for the upper arm for the second sub-rotation angle, and determine the second sub-rotation angle of the upper arm based on the distance from the first part to the second part, the first rotation angle of the lower arm, and the second length correction value.

9. The electronic device of claim 8, wherein the second length correction value is calculated to decrease as a difference between the first rotation angle and the first sub-rotation angle in a first space generated by projecting the three-dimensional space on a horizontal plane increases.

10. The electronic device of claim 1, wherein the first part of the body corresponds to a shoulder joint of the user, the second part of the lower arm corresponds to a wrist joint of the user, and the second rotation angle of the upper arm represents a rotation angle of the upper arm with respect to the shoulder joint.

11. The electronic device of claim 1, further comprising:

a cable driver configured to generate tension or torque to be applied to the cable based on a control signal generated by the at least one processor.

12. The electronic device of claim 1, wherein when executed by the at least one processor individually and/or collectively, the instructions cause the electronic device to at least:

receive the rotation information from an external electronic device worn by the user through a communication module, comprising communication circuitry, of the electronic device.

13. A method of determining an arm posture of a user of a wearable apparatus comprising a cable, a first sensor configured to be disposed proximate at least a part of a body of a user and configured to generate length information of the cable, and a second sensor configured to be disposed proximate to a second part of a lower arm of the body of the user and configured to generate rotation information of the lower arm, the method comprising:

determining a distance from a first part of the body of the user to the second part of the lower arm of the user based on the length information of the cable generated by the first sensor;

determining a first rotation angle of the lower arm in a three-dimensional space based on the rotation information generated by the second sensor;

determining a second rotation angle of an upper arm in the three-dimensional space based on the distance from the first part to the second part and the first rotation angle of the lower arm;

determining a position of the upper arm and a position of the lower arm in the three-dimensional space based on the first rotation angle of the lower arm and the second rotation angle of the upper arm; and determining the arm posture based on the position of the upper arm and the position of the lower arm, and generate display information for displaying on a display a current appearance of the user based on the determined arm posture.

14. A wearable device comprising:

a cable;

a cable driver configured to generate tension or torque to be applied to the cable;

a first sensor connected to the cable, configured to be disposed proximate at least a part of a body of a user, and configured to generate length information of the cable a cable;

at least one processor comprising processing circuitry; and memory storing instructions that when executed by the at least one processor individually and/or collectively, cause the wearable device to at least:

determine a distance from a first part of the body of the user to a second part of a lower arm of the user based on the length information of the cable generated by the first sensor, determine a first rotation angle of the lower arm in a three-dimensional space based on rotation information generated by a second sensor configured to be disposed proximate to the second part, determine a second rotation angle of an upper arm in the three-dimensional space based on the distance from the first part to the second part and the first rotation angle of the lower arm, determine a position of the upper arm and a position of the lower arm in the three-dimensional space based on the first rotation angle of the lower arm and the second rotation angle of the upper arm, determine an arm posture of the user based on the position of the upper arm and the position of the lower arm, and generate display information for displaying on a display a current appearance of the user based on the determined arm posture.

15. The wearable device of claim 14, wherein when executed by the at least one processor individually and/or collectively, the instructions cause the wearable device to at least:

determine an initial length of the cable based on the length information, and determine the distance from the first part of the body of the user to the second part of the lower arm of the user based on the initial length, a position of the first sensor, and a position of the first part.

16. The wearable device of claim 14 wherein when executed by the at least one processor individually and/or collectively, the instructions cause the wearable device to at least:

determine the first rotation angle of the lower arm based on reference rotation information obtained by the second sensor and the rotation information, when the arm posture is a calibration posture.

17. The wearable device of claim 14, wherein when executed by the at least one processor individually and/or collectively, the instructions cause the wearable device to at least:

determine a first sub-rotation angle of the upper arm based on the first rotation angle of the lower arm and the distance from the first part to the second part in a first space generated by projecting the three-dimensional space on a horizontal plane, determine a second sub-rotation angle of the upper arm based on the first rotation angle of the lower arm and the distance from the first part to the second part in a second space generated by projecting the three-dimensional space on a vertical plane, and determine the second rotation angle of the upper arm based on the first sub-rotation angle and the second sub-rotation angle.

18. The wearable device of claim 17, wherein when executed by the at least one processor individually and/or collectively, the instructions cause the wearable device to at least:

determine a first length correction value for the upper arm for the first sub-rotation angle, and determine the first sub-rotation angle of the upper arm based on the distance from the first part to the second part, the first rotation angle of the lower arm, and the first length correction value.

19. The wearable device of claim 18, wherein the first length correction value is calculated to decrease as the distance from the first part to the second part increases.

20. The wearable device of claim 14, further comprising: the second sensor.

* * * * *